United States Patent [19]

Good et al.

[11] Patent Number: 5,042,530

[45] Date of Patent: Aug. 27, 1991

[54] SUBSEA WELLHEAD APPARATUS

[75] Inventors: Craig A. Good, Houston; Edward C. Gaude, Pearland; John F. Veatch, Houston, all of Tex.

[73] Assignee: Hydril Company, Houston, Tex.

[21] Appl. No.: 567,104

[22] Filed: Aug. 14, 1990

Related U.S. Application Data

[63] Continuation of Ser. No. 343,018, Apr. 25, 1989, abandoned.

[51] Int. Cl.[5] ..... E21B 7/12

[52] U.S. Cl. ..... 137/625.64; 91/433; 166/336

[58] Field of Search ..... 137/487.5, 625.64; 91/433; 166/321, 335, 336

[56] References Cited

U.S. PATENT DOCUMENTS 4,061,155 12/1977 Sopha ..... 91/433 X
4,636,934 1/1987 Schwendemann et al. .... 166/336 X
4,798,527 1/1989 Ginda ..... 137/487.5

FOREIGN PATENT DOCUMENTS 2567191 1/1986 France ..... 166/336
2582048 11/1986 France ..... 166/335

*Primary Examiner*—John C. Fox
*Attorney, Agent, or Firm*—Vaden, Eickenroht, Thompson & Boulware

[57] ABSTRACT

There is disclosed a system for controlling the operation of a ram of a subsea blowout preventer connected to a piston shiftable between alternate positions within a cylinder. The system includes valve apparatus for so shifting the piston which includes an outlet connected to the cylinder, a first passageway through which hydraulic fluid may be supplied to the outlet, a second passageway through which hydraulic fluid may be vented from the outlet, and a valve member movable between positions alternately connecting the outlet with the first and second passageways, respectively, so as to selectively supply hydraulic fluid to or vent hydraulic fluid from the cylinder.

4 Claims, 3 Drawing Sheets

SUBSEA WELLHEAD APPARATUS

Figure 1:
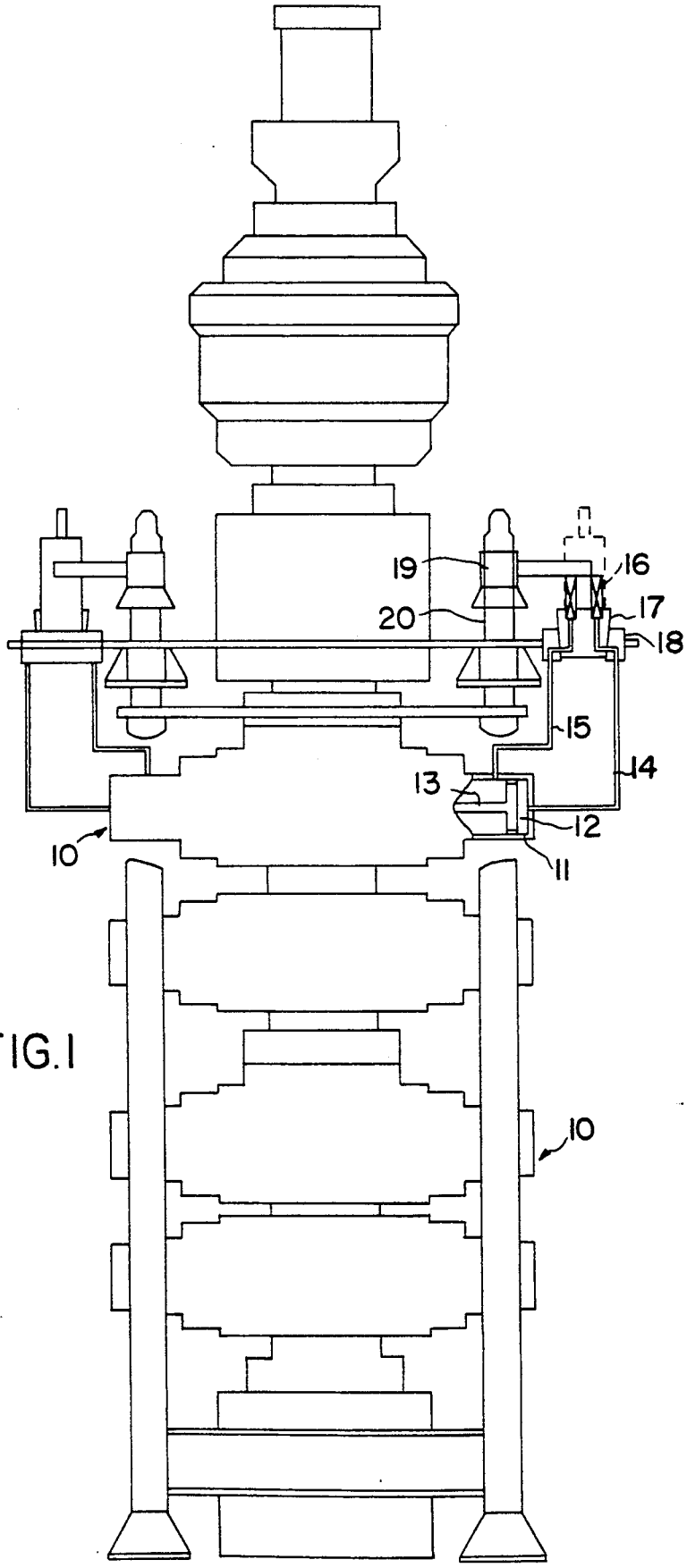

This application is a continuation of our previous patent application, Ser. No. 07/343,018, filed Apr. 25, 1989 and entitled "Subsea Wellhead Apparatus".

This invention relates generally to subsea wellhead apparatus, and, more particularly, to improvements in systems for controlling the operation of a component of a subsea blowout preventer stack having a piston reciprocable within a cylinder.

In the drilling of a subsea well, a blowout preventer stack is installed on the wellhead at the ocean floor. The stack has hydraulically operable components including rams which are adapted to be reciprocated between opened and closed pistons with respect to a bore through the preventer housing. In their closed positions, the rams close about a drill string within the bore or close off the bore when empty. Operators for opening and closing the rams include pistons reciprocable within cylinders in the housing. Ordinarily, these operators are double acting in the sense that hydraulic fluid is supplied to one side of the piston while being exhausted from the other.

Prior systems of this type have included a main control valve having a valve member movable between positions for supplying hydraulic fluid to or venting hydraulic fluid from opposite sides of the piston. This valve member has been moved between its alternate positions by an hydraulically actuated operator to which hydraulic fluid is supplied or from which hydraulic fluid is exhausted by means of a pilot valve. The pilot valve is in turn shifted between its alternate position by means of a solenoid which responds to electrical current supplied from a remote location.

It is of course important to know whether or not the operating pistons and thus the rams of the preventer, or other components of the stack to be controlled, have been moved to a desired position. In a prior hydraulically operated system of this type, the intended function is inferred by sensing and providing an indication of the pressure of hydraulic fluid supplied to the operator for the valve member of the main control valve. Such a signal is of course unreliable for this purpose in the event the operator fails to shift the valve member despite the supply or exhaust of hydraulic fluid to or from the operator. In a prior electrically controlled system of this type, the intended function is inferred by sensing and indicating a signal responsive to the supply of current to the solenoid. This signal is also unreliable for this purpose in the event of malfunction of the solenoid or failure of the pilot valve to shift.

An object of this invention is to provide a system in which the positions of the piston may be inferred in a more reliable manner.

In such prior systems, the pilot valve is divorced from the main control valve for controlling the supply and exhaust of hydraulic fluid to and from the piston of the component. This has required bulky equipment including, among other things, hydraulic and/or electrical conduits extending between the pilot valve and the main valve, thus not only making the system expensive, but also complicated to install and/or repair. Also, the solenoid of such a system may be mounted on or in a large junction box filled with fluid for pressure compensation.

Another object of this invention is to provide a system of this type which is of more compact and less expensive construction, and, more particularly, which does not require hydraulic and/or electrical conduits extending between the pilot valve and main valve.

These and other objects are accomplished, in accordance with the illustrated embodiment of the present invention, by a system of the type described, including a main control valve having an outlet connected to the cylinder, a first port through which hydraulic fluid may be supplied to the outlet, and a second port through which hydraulic fluid may be vented from the outlet. More particularly, the main valve also includes a valve member which is movable between positions alternately connecting the outlet with the first and second ports, respectively, so as to selectively supply hydraulic fluid to or vent hydraulic fluid from the cylinder, and remotely operable means for so moving the valve member.

In accordance with one novel aspect of the invention, a means is connected with the outlet for directly sensing the pressure of the hydraulic fluid supplied to the outlet and transmitting a signal representative of the sensed pressure to a remote location. Because of this direct connection, the positions of the piston may be more reliably inferred since only failure of the piston itself to be moved prevents a correct reading.

In the illustrated embodiment of the invention, the sensing means comprises a fluid pressure responsive switch, and a passageway connecting the outlet and switch. However, other means for directly sensing the pressure are contemplated within the scope of the invention. As also illustrated, the remotely operable means comprises hydraulically operable means on the valve member, a pilot valve shiftable between positions in which hydraulic fluid may be supplied to or extended from the hydraulically operable means, and a solenoid for so shifting the pilot valve in response to electrical signals from a remote location.

In accordance with another novel aspect of the invention, the main control valve and the solenoid actuated pilot valve for shifting the hydraulically operated valve member of the main valve are disposed within the same body. More particularly, passageways in the body connect the pilot valve with the operator and a source of hydraulic fluid, whereby the valve apparatus is not only compact, but also avoids the need for external conduits required by prior systems of this type. More particularly, in the preferred and illustrated embodiment of the invention, the body of the valve apparatus has a bore in which the valve member of the main valve is shiftable to open and close the outlet from the bore which connects with the cylinder, and means including a passageway through the rod directly connects the bore with the sensor, thereby further obviating the need for external conduits.

Figure 2:
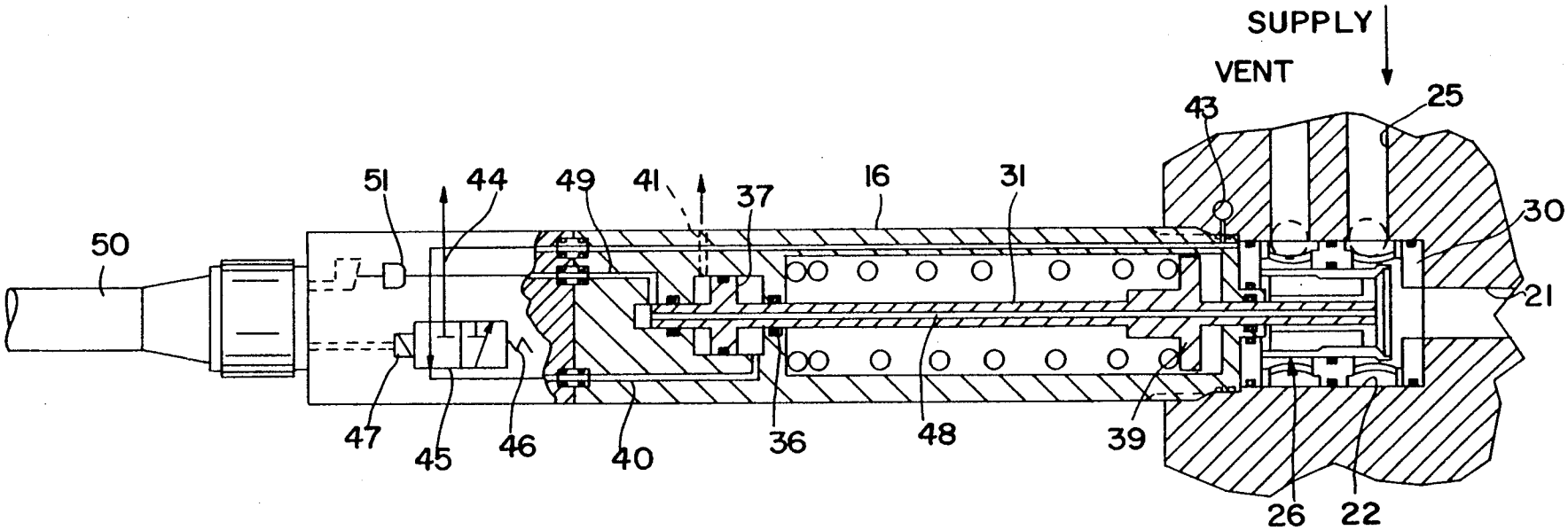
Figure 3:
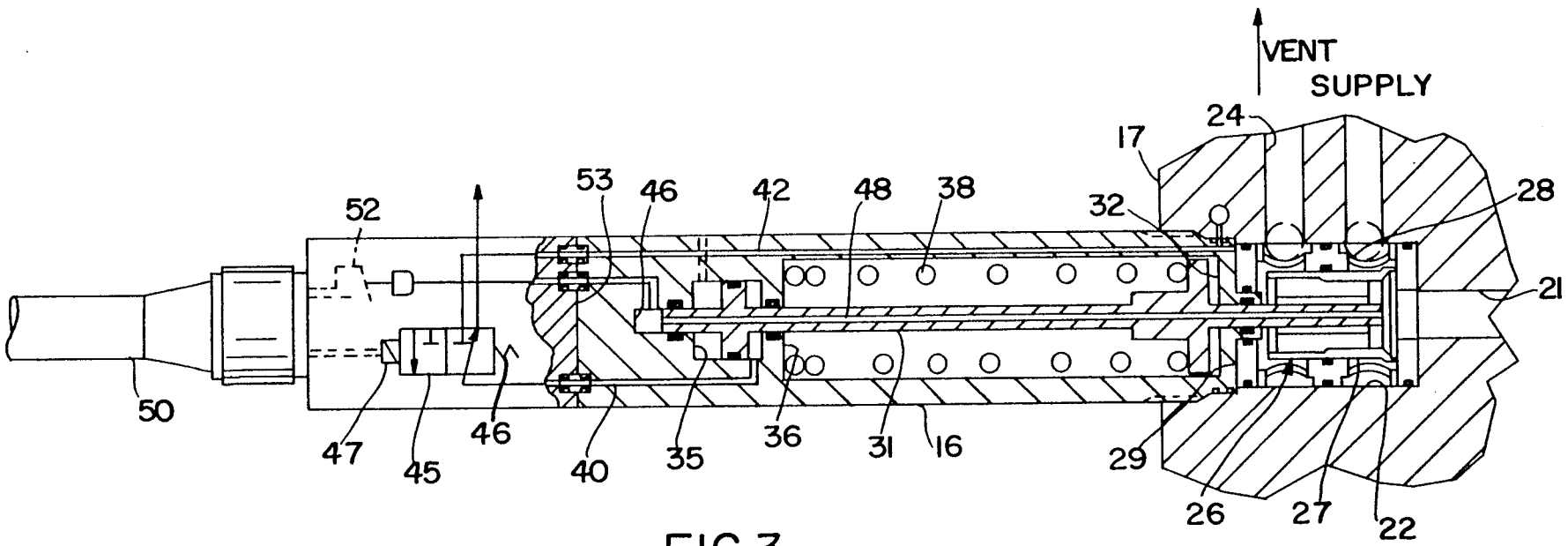

In the drawings, wherein like reference characters are used throughout to indicate like parts:

FIG. 1 is a side view of a portion of a subsea blowout preventer stack including a ram type blowout preventer and a system for controlling operation of the rams thereof including valve apparatus constructed in accordance with the present invention and so installed on the stack as to connect the outlet from its main control valve with a cylinder in which a piston of the ram operator reciprocates;

FIG. 2 is a view of the valve apparatus, partly in longitudinal section and partly in diagrammatic form, with the solenoid operated pilot valve moved to a position for causing the main control valve to shift to a position for supplying hydraulic fluid to the cylinder; and FIG. 3 is a view similar to FIG. 2, but in which the pilot valve has been moved to a position for shifting the main valve to a position for venting such fluid from the cylinder.

With reference now to the details of the above described drawings, the ram type blowout preventers 10 shown in FIG. 1 to be installed on the upper end of a subsea wellhead include housings having a bore through and rams reciprocal within guideways in the housing for opening and closing the bore. The rams are moved between opened and closed positions by means of hydraulic actuators which include, as shown in the broken away portion on the right-hand side of the uppermost preventer, a cylinder 11 having a piston 12 reciprocal therein and a rod 13 extending from the piston for connection with one of the rams.

Each such ram is moved inwardly and outwardly in response to the alternate supply of hydraulic pressure to or exhaust of hydraulic fluid from the cylinder on opposite sides of the piston. For this purpose, a conduit 14 connects with the cylinder on the outer side of the piston, while a conduit 15 connects with the cylinder on the inner side of the piston. The supply of hydraulic fluid through one such conduit and exhaust of hydraulic fluid through from the other conduit is controlled by means of valve apparatus constructed in accordance with the present invention and shown diagrammatically in FIG. 1 to include a valve body 16 having its inner end installed on a pod 17 which is received within a receptacle 18 mounted on the stack above the preventer. The pods have been lowered into the receptacles by means of a guide structure including guide sleeves 19 slidable over guide posts 20. As will be described in connection with FIGS. 2 and 3, an outlet 21 is formed in the pod at the end of each valve body 16 for connecting with one of the conduits 14 and 15.

As shown in FIGS. 2 and 3, the valve apparatus has a cavity 22 formed in the pod 17 intermediate the end of the valve body 16 and the outlet 21 from the opposite end of the cavity. Ports 24 and 25 are formed in the pod to connect with the side of the cavity, the port 25 connecting with the supply side of a source of hydraulic fluid and the port 24 connecting with the return side thereof. The valve apparatus further includes a valve member 26 which is reciprocable within the cavity 22 between the position of FIG. 2 in which hydraulic fluid is supplied from the port 25 into the outlet 21, and the position of FIG. 3 wherein hydraulic fluid is vented from the outlet 21 into the port 24.

The valve member includes sleeve 27 which is sealably slidable within a guide ring 28 mounted in the cavity intermediate the intersection of ports 24 and 25 therewith. When the valve member is shifted to the left to engage the left-hand end of the sleeve 26 with a seal ring 29 in the left end of the cavity, as shown in FIG. 2, its right hand is spaced from the seal ring 30 in the right-hand side of the cavity to connect port 25 only with the outlet 21. On the other hand, when the sleeve shifts to the right, as shown in FIG. 3, its right-hand end engages the ring 30 while its left-hand end is spaced from the ring 29 to connect port 24 only with the outlet 21. A valve of this basic construction is made and sold by the Gilmore Valve Company of Bellaire, Tex.

The valve member is reciprocated between these alternate positions by means of a valve stem 31 which extends sealably through an inner end wall 32 of the valve body 16 which closes the outer end of the cavity. As shown, the rod has a flange 39 thereabout on the inner side of end wall 32, and a spring 38 is compressed between the flange and an intermediate wall 36 of the valve body through which the outer end of the stem extends so as to thus urge the rod and thus the valve member to the right and thus toward the closed position of FIG. 3. In this position, of course, the valve member is positioned to permit hydraulic fluid to be vented from the outlet into the port 24.

The valve member is adapted to be moved to its supply position by means of a hydraulic operator which includes a cylinder 35 formed in the valve body outwardly of the intermediate wall 36, and a piston 37 on the outer end of the stem which reciprocates within the cylinder 35. More particularly, the outermost end of the rod extends sealably into a chamber formed in the valve body outwardly of the cylinder 35 so as to enclose the cylinder for containing pressure of hydraulic fluid therein.

Hydraulic fluid is adapted to be alternately supplied to or exhausted from the cylinder 35 on the right-hand side of the piston 37 through a passageway 40 formed in the body of the valve, and the cylinder on the left side of the piston is vented through a passageway 41 leading to the exterior of the body. Upon the supply of hydraulic fluid to the chamber on the right side of piston 37, the stem is moved to the left in opposition to the force of the spring 38 so as to open the main valve to supply position. On the other hand, upon the exhaust of hydraulic fluid therefrom, the spring 38 moves the stem to the right in order to move the main control valve to vent position.

Hydraulic fluid is adapted to be supplied to the passageway 40 through another port 43 formed in the valve body and connecting with a passageway 42 formed in the pod portion of the valve apparatus for connection with a suitable source of hydraulic fluid. On the other hand, hydraulic fluid is exhausted from the passageway 40 through a passageway 44 formed in the valve body and connecting to the exterior thereof. The alternate supply and exhaust of hydraulic fluid to and from the chamber 35 is controlled by means of a pilot valve 45 shown diagrammatically to be shiftable between the FIG. 2 position connecting conduit 40 with conduit 42 in order to supply hydraulic fluid to the chamber, and the FIG. 3 position connecting passageway 40 with passageway 44 to vent hydraulic fluid therefrom.

The pilot valve 45 is urged by a spring 46 to its FIG. 3 venting position, but is shiftable to its alternate FIG. 2 supply position by actuation of a solenoid 47 at one end thereof. The solenoid is adapted to be actuated by electrical current supplied thereto by an electrical conductor which extends within a cable 50 connected to one end of the valve body for extension to a source of current at a remote location. Upon deactivation of the solenoid, spring 46 returns the pilot valve to its vent position.

As shown, the stem 31 has a passageway 48 formed therethrough to connect the outlet 21 at one end of the valve apparatus with the cavity or chamber 46 formed in the valve body at the left-hand end of the stem. A further passageway 49 is formed in the valve body to connect the chamber 46 with a pressure sensor 51 which is in turn connected to a normally open switch 52. The switch is connected to electrical conductors which extend through the cable for transmitting a signal to a remote source upon closing of the switch. The switch is in an open position in FIG. 3, but in FIG. 2 is shown moved to a closed position in response to the pressure of hydraulic fluid within the passageway 49 and thus from the outlet 21. Thus, the pressure sensor and switch transmit a signal through cable 50 to indicate that hydraulic fluid at a desired pressure level has been supplied to the conduit 21 and thus to one side of the piston of the ram operator of the blowout preventer 10.

From the foregoing, it is apparent that the resulting valve apparatus is of very compact construction in that all of the components thereof, including not only the valve member of the control valve, but also its hydraulic operator and the pilot valve for controlling the operator are contained within a single body. More particularly, all of the hydraulic passageways and electrical conduits connecting with the multiplex cable 50 are so contained. As shown in FIGS. 2 and 3, however, the single body may be formed in separate sections having their end walls joined along the face 53. This permits the electrical operated components of the valve apparatus, including the pilot valve and the pressure sensor and switch, to be replaced or repaired independently of the main control valve and its hydraulic operator. As shown, this merely requires pressure tight connections between the ends of the hydraulic passageways, such as the seal sleeves shown in the drawings.

Reviewing now the overall operation of the valve apparatus, and assuming that hydraulic fluid is to be supplied to one side of the piston, such as its outer side for closing the ram, the solenoid 47 is actuated in order to shift the pilot valve to its FIG. 2 position. In this position, the pilot valve connects passageway 42 with passageway 40 in order to supply hydraulic fluid to the cylinder 35 on the right-hand side of the piston 37. The valve stem 31 is thus forced to the left, against the urging of the spring 38, so as to shift the valve member 26 to the position shown in FIG. 2 wherein it connects supply passageway 25 with the outlet 21. With the other valve moved to vent position of FIG. 3, so that hydraulic fluid is vented from the other side of the piston of the ram operator, supply pressure in the outlet 21 closes switch 52 to provide the remote signal.

When the ram is to be moved to its alternate position, the solenoid 47 is deactivated to permit the pilot valve to be spring pressed to the position of FIG. 3, and thus connect passageway 40 with vent passageway 44. This vents hydraulic fluid from the chamber 35 on the right-hand side of the piston 37 and thus permits the spring 38 to move the valve stem and thus the valve member to the right-hand position of FIG. 3. In this position, of course, hydraulic fluid is vented from one side of the piston of the ram operator, so that shifting of the other valve to its supply position permits the operator to move the ram to its alternate positions. The venting of hydraulic fluid from the outlet, and thus the lower pressure transmitted to sensor 51, permits the switch to open and thus discontinues the signal.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. In combination with a subsea blowout preventer stack having a system for controlling the operation of a component of the stack which includes a piston shiftable between alternative positions within a cylinder, valve apparatus for so shifting the piston including an outlet connected to the cylinder, a first port through which hydraulic fluid may be supplied to the outlet, a valve member movable between positions alternately connecting the outlet with the first and second ports respectively, so as to selectively supply hydraulic fluid to or vent hydraulic fluid from the cylinder, remotely operable means for so moving the valve member, and means connected with the outlet for directly sensing the pressure of the hydraulic fluid in the cylinder and transmitting a signal representative of the sensed pressure to a remote location at the water surface.

2. Valve apparatus of the character defined in claim 1, wherein the sensing means comprises a fluid pressure responsive switch, and a passageway connecting the outlet and switch.

3. A valve apparatus of the character defined in claim 1, wherein said remotely operable means comprises hydraulically operable means on the valve member, pilot valve means shiftable between positions in which hydraulic fluid may be supplied to or extended from the hydraulically operable means, and a solenoid for so shifting the pilot valve means in response to signals from a remote location.

4. Valve apparatus of the character defined in claim 3, wherein the hydraulically operable means comprises a piston reciprocable in a chamber, a rod connecting the piston with the valve member, and means for supplying hydraulic fluid to or venting hydraulic fluid from the chamber so as to so reciprocate the piston and thereby move the valve member between its alternate positions, and the sensing and transmitting means includes a passageway in the rod.

* * * * *